US010276960B2

(12) United States Patent
Aoki

(10) Patent No.: US 10,276,960 B2
(45) Date of Patent: Apr. 30, 2019

(54) CONNECTOR

(71) Applicant: Yazaki Corporation, Tokyo (JP)

(72) Inventor: Eiji Aoki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/005,531

(22) Filed: Jun. 11, 2018

(65) Prior Publication Data

US 2018/0358728 A1 Dec. 13, 2018

(30) Foreign Application Priority Data

Jun. 12, 2017 (JP) ..... 2017-115434

(51) Int. Cl.
*H01R 24/00* (2011.01)
*H01R 13/17* (2006.01)
*H01R 13/629* (2006.01)

(52) U.S. Cl.
CPC ..... *H01R 13/17* (2013.01); *H01R 13/62933* (2013.01)

(58) Field of Classification Search
CPC ... H01R 13/15; H01R 13/17; H01R 13/62933
USPC ..... 439/660, 675
See application file for complete search history.

(56) References Cited

U.S. PATENT DOCUMENTS 9,331,400 B1 * 5/2016 Bianca ..... H01R 13/05
10,141,670 B1 * 11/2018 Stevenot ..... H01R 13/2421
10,199,750 B2 * 2/2019 Endo ..... H01R 4/48
2014/0213087 A1 7/2014 Furuya et al.

FOREIGN PATENT DOCUMENTS

JP 2014-146451 A 8/2014

* cited by examiner

*Primary Examiner* — Khiem M Nguyen
(74) *Attorney, Agent, or Firm* — Kenealy Vaidya LLP

(57) ABSTRACT

A connector includes a plurality of terminal units. The terminal unit includes a terminal main body, a plug cap having the terminal main body inserted therein, fitted with a counterpart connector, and formed in a cylindrical shape, and a contact passing between the terminal main body and the plug cap. The contact includes a first connecting portion having a first abutting portion abutting on an outer circumferential surface of the terminal main body and a second connecting portion having a second abutting portion abutting on an inner circumferential surface of the plug cap. At least either the first connecting portion or the second connecting portion is a spring member movably biasing the plug cap in a perpendicular direction to a fitting direction with the counterpart connector in a state in which electric connection to the terminal main body is maintained.

4 Claims, 7 Drawing Sheets

CONNECTOR

BACKGROUND

Technical Field

The present disclosure relates to a connector including a plurality of terminals.

Related Art

Conventionally, to fit or detach a connector including a plurality of terminals, in a case in which the connector is to be fitted diagonally, or in a case in which a dimensional tolerance at the time of manufacture of the parts exists, an angular error occurs between male terminals and female terminals. In this case, a user sometimes pries the connector during the work. Thus, a contact state between the terminals may become poor, or contact pressure between the terminals may become high, which may make it difficult to detach the terminals from each other and may lower the workability. Under such circumstances, various connectors that can absorb the angular error between the terminals are proposed (for example, refer to JP 2014-146451 A).

A power supply shutoff apparatus described in JP 2014-146451 A includes a plug connector housing four male terminals and a receiving connector housing four female terminals, and each of the female terminals includes a conductive member having a columnar opening and a cylindrical female electrode housed in this conductive member and provided with a plurality of spring members. Accordingly, when the plug connector and the receiving connector are fitted with each other, the angular error between the terminals can be absorbed by the spring members of the female electrodes.

Patent Literature 1: JP 2014-146451 A

SUMMARY

In the conventional connector, when the plug connector and the receiving connector are fitted, the male terminals are directly inserted into the female electrodes of the receiving connector. For this reason, during prolonged use of the conventional connector, due to abrasion and deformation of the spring members of the female electrodes caused by connection and disconnection of the male terminals, absorption capability for the angular error may be lowered, and sufficient contact pressure and contact area between the male terminals and the female electrodes cannot be obtained.

In consideration of the above problems, an object of the present disclosure is to provide a connector enabling an angular error between terminals to be absorbed and withstanding prolonged use.

A connector according to an embodiment of the present disclosure includes: a plurality of terminal units, wherein the terminal unit includes: a terminal main body; a cylindrical plug cap having the terminal main body inserted therein and fitted with a counterpart connector; and a cylindrical contact that passes between the terminal main body and the plug cap, wherein the contact includes: a first connecting portion having a first abutting portion abutting on an outer circumferential surface of the terminal main body; and a second connecting portion having a second abutting portion abutting on an inner circumferential surface of the plug cap, and wherein at least either the first connecting portion or the second connecting portion is a spring member that movably biases the plug cap in a perpendicular direction to a fitting direction with the counterpart connector in a state in which electric connection to the terminal main body is maintained.

In the connector according to an embodiment of the present disclosure, each of the first connecting portion and the second connecting portion is preferably a spring member that biases the terminal unit in the perpendicular direction to the fitting direction with the counterpart connector.

In the connector according to an embodiment of the present disclosure, in the terminal unit, a tip end of the terminal main body is preferably protruded further on a tip end side in the fitting direction with the counterpart connector than the plug cap, and the terminal unit preferably further includes a terminal cap attached to the tip end of the terminal main body to prevent the plug cap from coming off.

According to the present disclosure, at least either the first connecting portion or the second connecting portion of the contact in the terminal unit is a spring member movably biasing the plug cap in the perpendicular direction to the fitting direction with the counterpart connector in a state in which electric connection to the terminal main body is maintained. Hence, even in a case in which an angular error occurs between the terminal unit and a terminal of the counterpart connector when the connector and the counterpart connector are to be fitted, the plug cap moves, and the angular error can be absorbed. Also, due to the contact, electric connection between the terminal main body and the plug cap can be maintained. Further, since the contact is inserted between the terminal main body and the plug cap, the spring member of the contact does not come in direct contact with a member such as the terminal of the counterpart connector, abrasion and deformation resulting from prolonged use can be restricted, and the connector withstanding prolonged use can be provided.

DETAILED DESCRIPTION

A "connector" according to an embodiment of the present disclosure will be described with reference to FIGS. 1 to 7. For example, the "connector" according to the embodiment of the present disclosure is provided in a power supply shutoff apparatus interposed between a power supply and a load although the connector is not limited as long as it is a connector.

Figure 1:
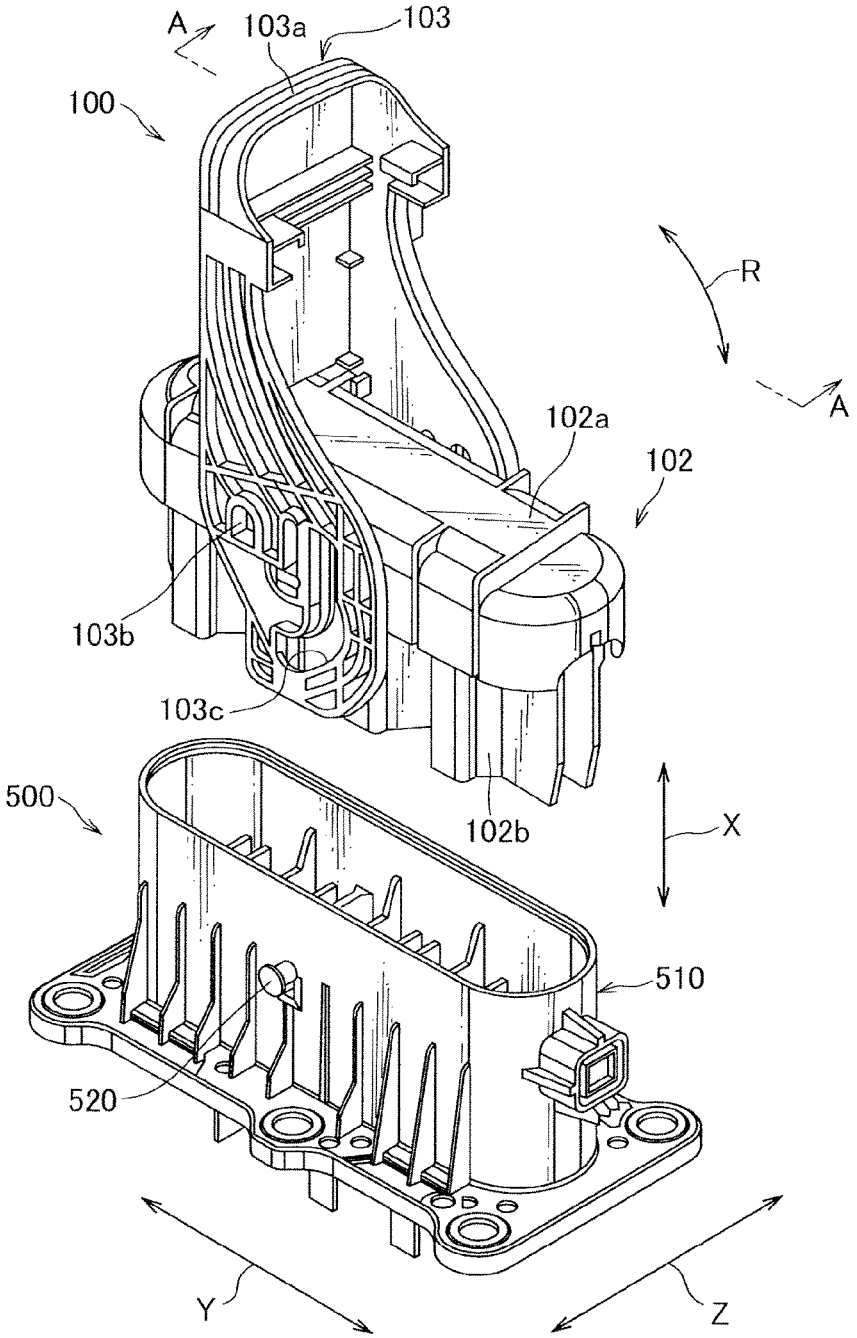
FIG. 1 is a perspective view illustrating a plug connector according to an embodiment of the present disclosure and a receiving connector to be fitted with the plug connector.
Figure 2:
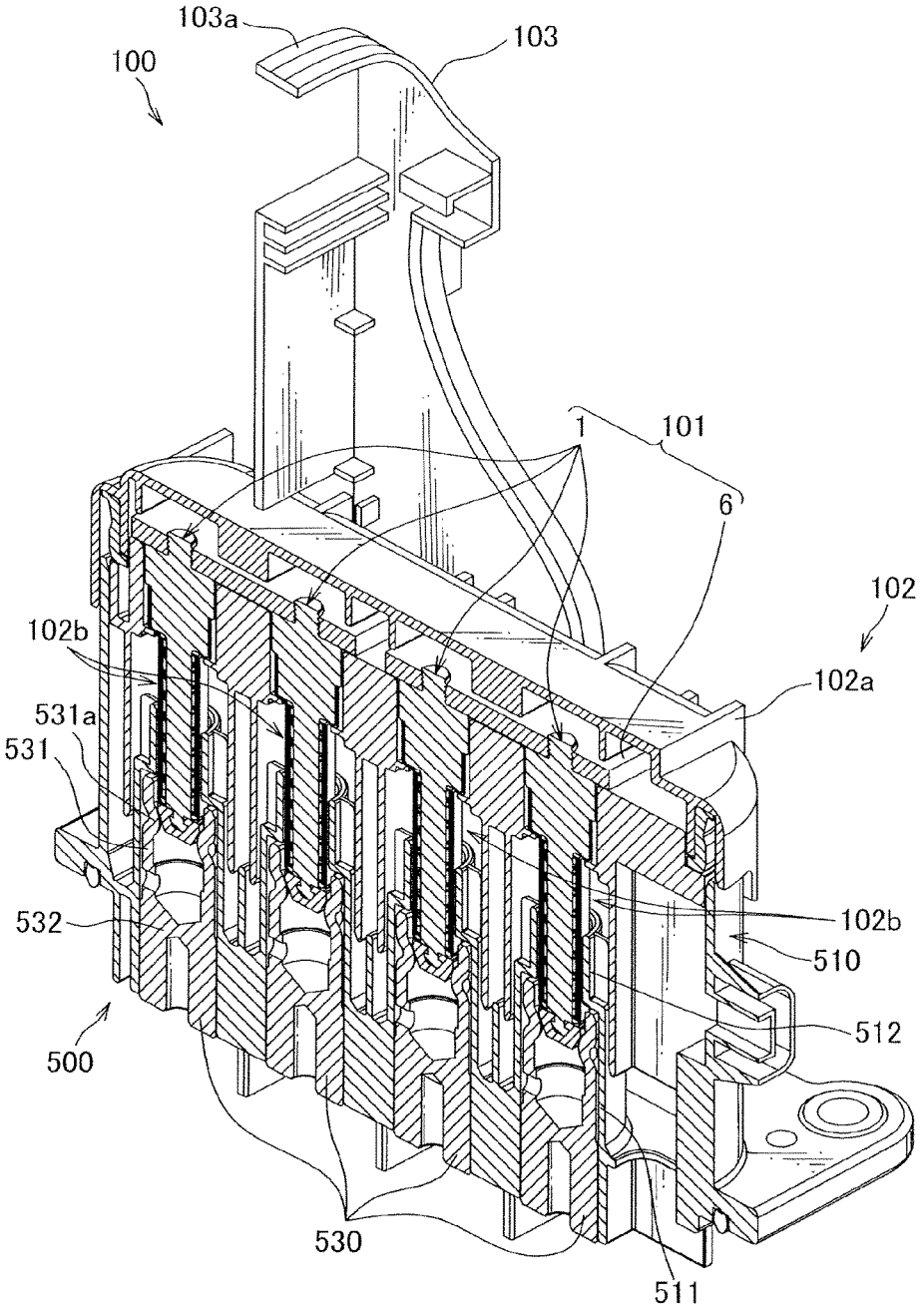
FIG. 2 is a cross-sectional view taken along arrow A-A in a middle state when the plug connector and the receiving connector illustrated in FIG. 1 are fitted.

A plug connector 100 (connector) according to the present embodiment includes a plurality of terminal units 1 and is fitted with a receiving connector 500 (counterpart connector) as illustrated in FIGS. 1 and 2. Although the plug connector 100 including four terminal units 1 is illustrated in the present embodiment, the number of terminal units 1 is not limited as long as it is plural. It is to be noted that, in the present embodiment, an up-down direction is a direction along a fitting direction between the plug connector 100 and the receiving connector 500, a lower side is a tip end side in the fitting direction, and an upper side is a rear end side in the fitting direction. Also, a right-left direction is a direction perpendicular to the fitting direction and a direction along an arranging direction of the plurality of terminal units 1. Also, a direction perpendicular to the up-down direction and the right-left direction is a width direction. In FIG. 1, the up-down direction is a direction of an arrow X, the right-left direction is a direction of an arrow Y, and the width direction is a direction of an arrow Z.

As illustrated in FIGS. 1 and 2, the plug connector 100 includes a terminal assembly 101 including the four terminal units 1, a plug housing 102 housing the terminal assembly 101 and opened at a lower part, and an operation lever 103 used for fitting and detaching operations between the plug connector 100 and the receiving connector 500.

As illustrated in FIG. 2, the terminal assembly 101 includes the four terminal units 1 and a conductive member 6 connecting the four terminal units 1. The conductive member 6 is made of a plate-like conductive material and is provided with four through holes 61 which securing portions 215 provided at top portions 21 of below-mentioned core posts 2 pass through. The through holes 61 are formed at predetermined intervals to correspond to the arrangement of the four terminal units 1. In the terminal assembly 101, the four terminal units 1 are conductive to each other by the conductive member 6.

As illustrated in FIGS. 1 and 2, the plug housing 102 includes a lid portion 102*a* and a terminal unit housing portion 102*b* housing the terminal units 1 and is made of a resin material. As illustrated in FIG. 2, the lid portion 102*a* is formed to cover an upper end of a receiving housing 510 of the below-mentioned receiving connector 500 when the plug connector 100 and the receiving connector 500 are fitted.

The terminal unit housing portion 102*b* has four independent housing spaces so that the four terminal units 1 can respectively be housed therein without contacting each other. Also, as illustrated in FIGS. 2 and 3, a part of the terminal unit housing portion 102*b* housing the top portion 21 of the core post 2 and a middle portion housing portion 31 of a plug cap 3 has an inside surface shape conforming to external shapes of the top portion 21 and the middle portion housing portion 31, and a part of the terminal unit housing portion 102*b* housing a side of the terminal assembly 101 further on the tip end side in the fitting direction than a terminal portion housing portion 32 has an inside surface shape conforming to external shapes of a receiving terminal housing portion 511 and a plug terminal housing portion 512 of the below-mentioned receiving housing 510.

As illustrated in FIGS. 1 and 2, the operation lever 103 includes an operation portion 103*a*, a shaft portion 103*b*, and a guide groove 103*c* and is made of a resin material. As illustrated in FIG. 1, the operation lever 103 strides over the plug housing 102 in the width direction and is attached to the plug housing 102 at two shaft portions 103*b*. The operation portion 103*a* is gripped for fitting and detaching operations between the plug connector 100 and the receiving connector 500. The shaft portion 103*b* pivotally supports the operation lever 103 to enable the operation lever 103 to be turned in a direction of an arrow R in FIG. 1 at the lid portion 102*a* of the plug housing 102. The guide groove 103*c* is provided along the turning direction R of the operation lever 103 and is engaged with an engaging projection portion 520 of the below-mentioned receiving connector 500 at the time of fitting and detaching operations between the plug connector 100 and the receiving connector 500.

Figure 3:
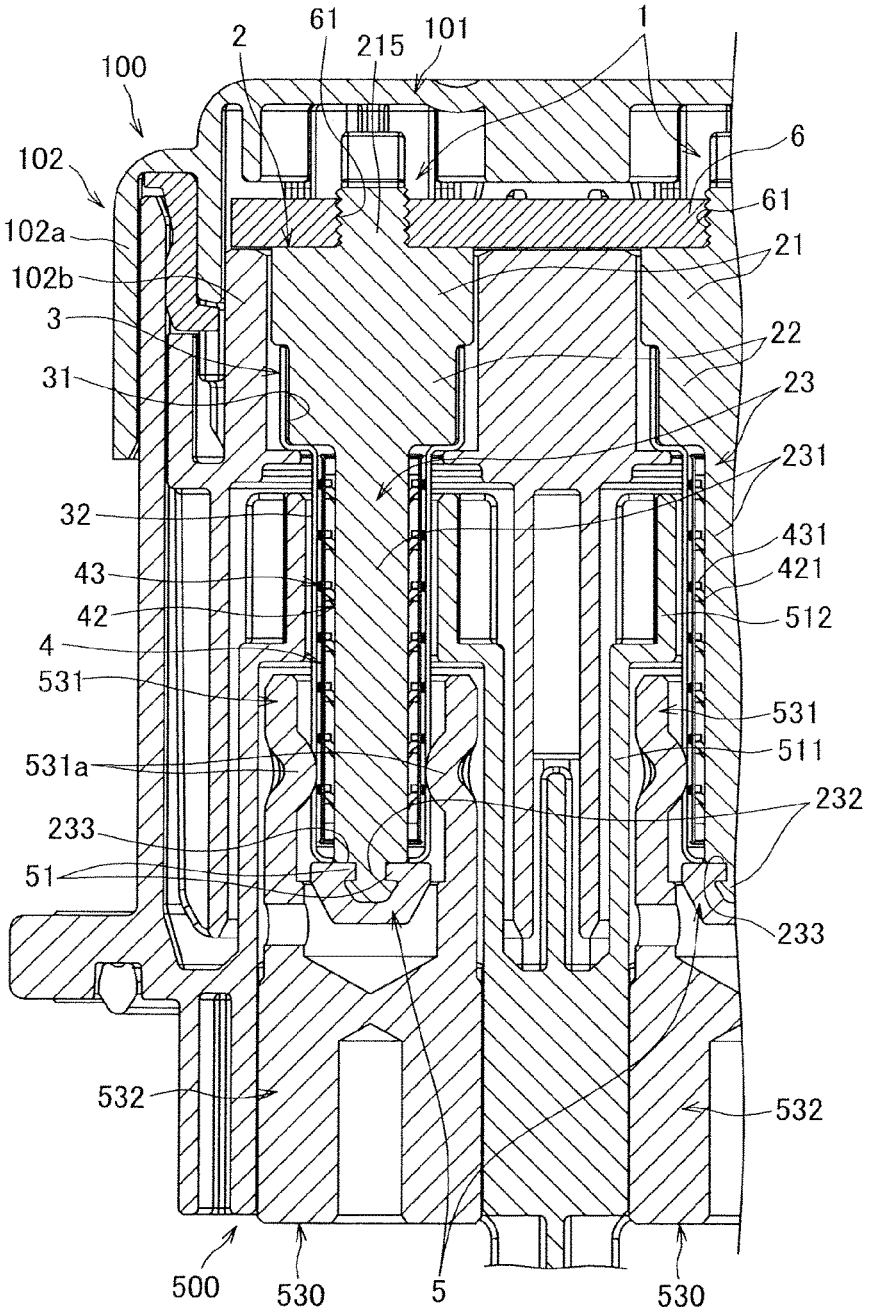
FIG. 3 is a cross-sectional view illustrating a main part in a state in which the plug connector and the receiving connector illustrated in FIG. 2 are fitted.
Figure 4:
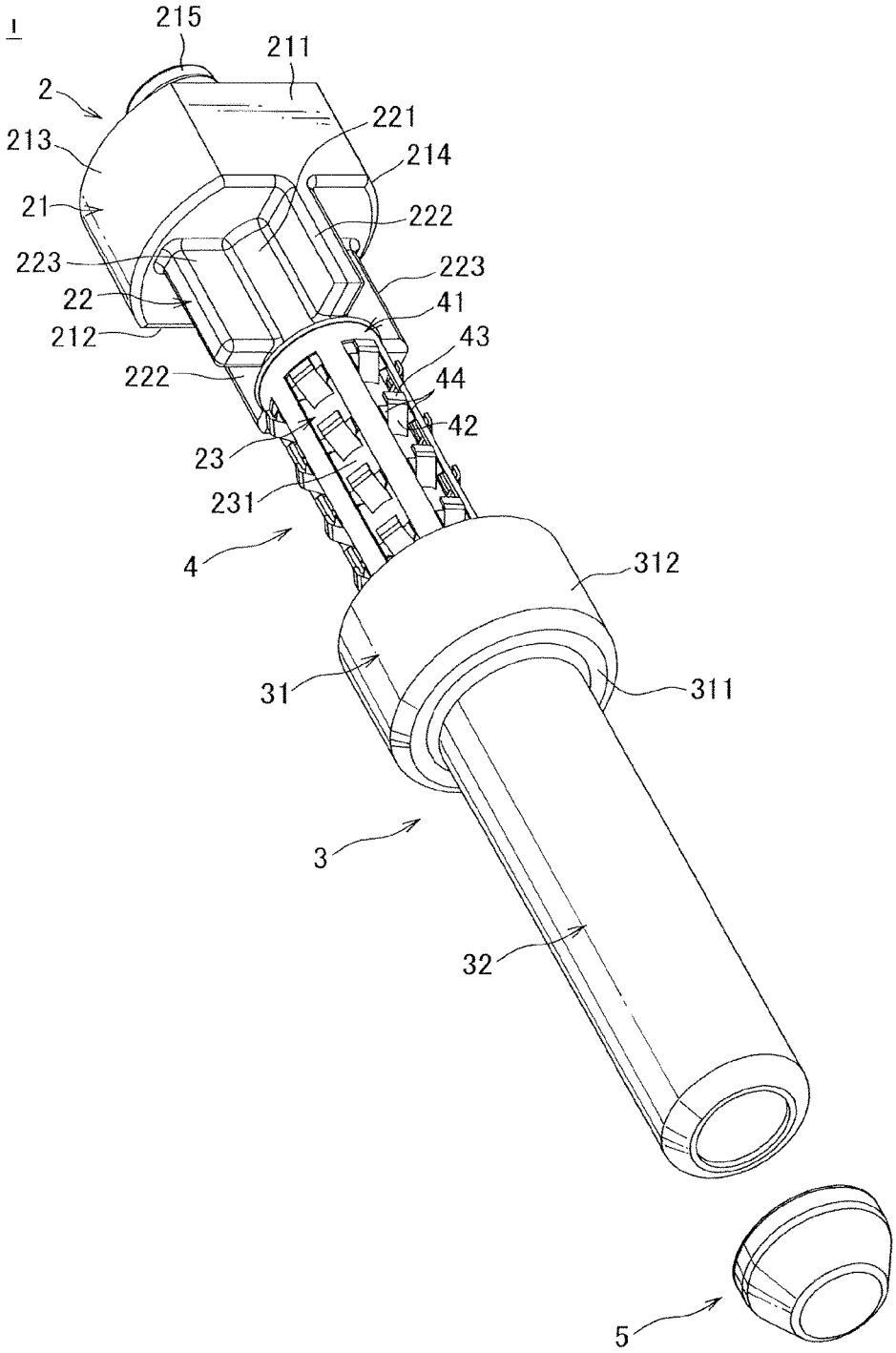
FIG. 4 is an exploded perspective view of a terminal unit in the plug connector illustrated in FIG. 1.

As illustrated in FIGS. 3 and 4, the terminal unit 1 includes the columnar core post 2 (terminal main body), the cylindrical plug cap 3 having the core post 2 inserted therein and fitted with the receiving connector 500, a cylindrical contact 4 passing between the core post 2 and the plug cap 3, and a terminal cap 5 engaged with the tip end side of the core post 2 in the fitting direction.

The core post 2 is made of a conductive material and includes the top portion 21, a middle portion 22, and a columnar terminal portion 23 in order from the rear end side to the tip end side in the fitting direction. The core post 2 is secured to the plug housing 102. When the plug connector 100 and the receiving connector 500 are fitted, the core post 2 is electrically connected to a receiving terminal 530 of the receiving connector 500 via the contact 4 and the plug cap 3.

The top portion 21 includes opposed side surface portions 211 and 212 formed in flat shapes, opposed side surface portions 213 and 214 formed in arc shapes in cross-sectional views, and a securing portion 215 protruded to the rear end side in the fitting direction and screw-cut. That is, the top portion 21 is formed in a columnar shape cut by the side surface portions 211 and 212.

The middle portion 22 includes a center shaft portion 221 and two ribs 222 and 223 extending along the fitting direction. The center shaft portion 221 has an equal diameter dimension to that of the terminal portion 23, is formed in a columnar shape, and communicates with a lower surface of the top portion 21 and the terminal portion 23. The rib 222 extends to both sides from the center shaft portion of the core post 2 to be perpendicular to the side surface portions 211 and 212, and the rib 223 extends to both sides from the center shaft portion 221 of the core post 2 to be perpendicular to the rib 222. Also, the rib 223 extends to positions further inside than edges of the side surface portions 213 and 214 approximately as long as the thickness dimension of the middle portion housing portion 31 of the below-mentioned plug cap 3 in the radial direction. When the terminal unit 1 is assembled, an upper end surface of the middle portion housing portion 31 abuts on the lower surface of the top portion 21. Also, an inside surface of the middle portion housing portion 31 of the plug cap 3 is located slightly further outward than the ribs 222 and 223.

The terminal portion 23 includes a columnar portion 231 formed in a columnar shape, a tip end portion 232 provided further on the tip end side in the fitting direction than the columnar portion 231, and an engaging groove 233 provided in the tip end portion 232 to cause the terminal cap 5 to be engaged therewith. In a state in which the terminal unit 1 is assembled, the tip end portion 232 protrudes further on the tip end side in the fitting direction than the plug cap 3 and the contact 4.

The plug cap 3 is a member to be fitted with the receiving terminal 530 of the below-mentioned receiving connector 500. The plug cap 3 has two cylindrical members made of a conductive material such as copper and having different diameter dimensions communicate and includes the middle portion housing portion 31 on the rear end side in the fitting direction and the terminal portion housing portion 32 on the tip end side in the fitting direction having a shorter diameter dimension than that of the middle portion housing portion 31.

The middle portion housing portion 31 is a part housing the middle portion 22 of the core post 2 and includes an annular bottom portion 311 and a sidewall portion 312 erecting from an outer edge of the bottom portion 311. The dimension of the middle portion housing portion 31 in the fitting direction is approximately equal to that of the middle portion 22 of the core post 2. To enable the plug cap 3 to move in the right-left direction, the diameter dimension of the inner circumferential surface of the middle portion housing portion 31 is set so that the inner circumferential surface of the middle portion housing portion 31 may be located further outside than the outer surface of the middle portion 22 in a state in which no external force is applied to spring members of the contact 4 (no load state). That is, when the terminal unit 1 is assembled, an inside surface of the bottom portion 311 abuts on lower surfaces of the ribs 222 and 223 of the core post 2.

The terminal portion housing portion 32 is a part housing the terminal portion 23 of the core post 2, the dimension thereof in the fitting direction is approximately equal to those of the columnar portion 231 of the terminal portion 23 and the contact 4, and the diameter dimension of the inner circumferential surface thereof is set so that the inner circumferential surface may abut on a second abutting portion 431 of a second connecting portion 43 of the below-mentioned contact 4.

Figure 5:
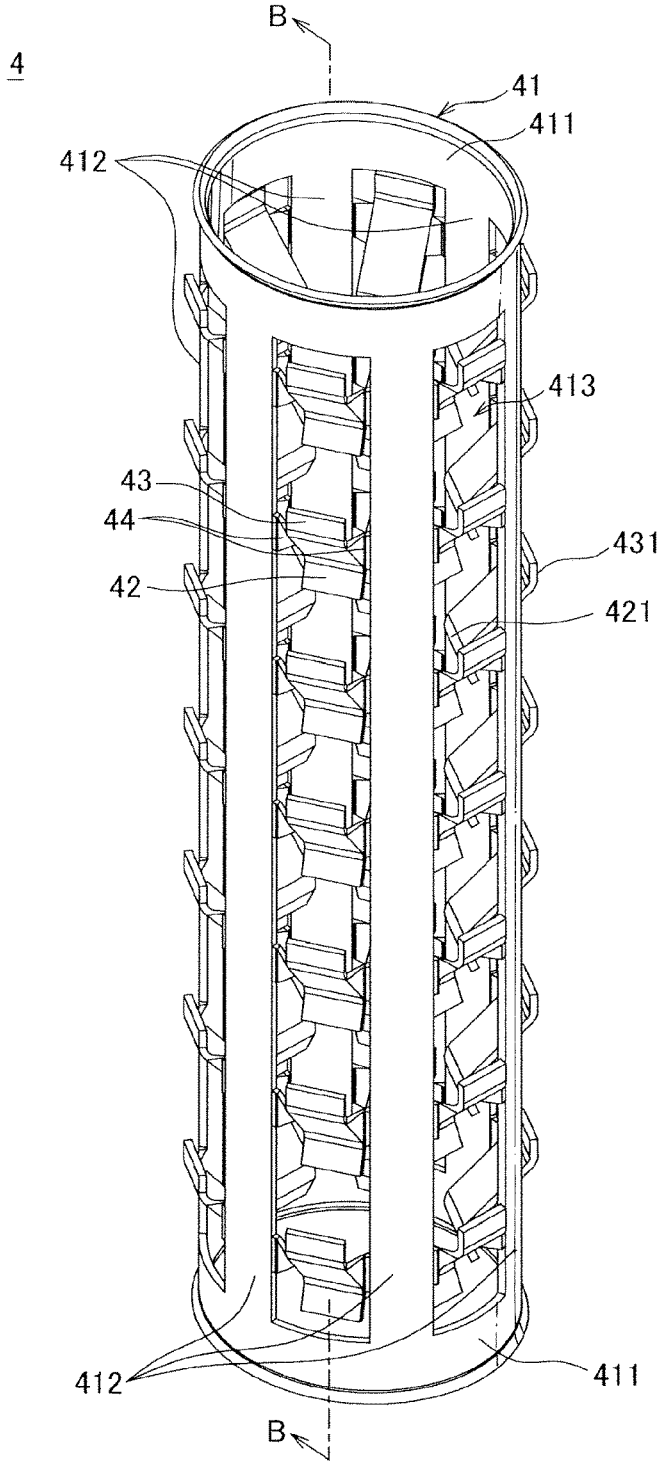
FIG. 5 illustrates a contact in the terminal unit illustrated in FIG. 4.
Figure 6:
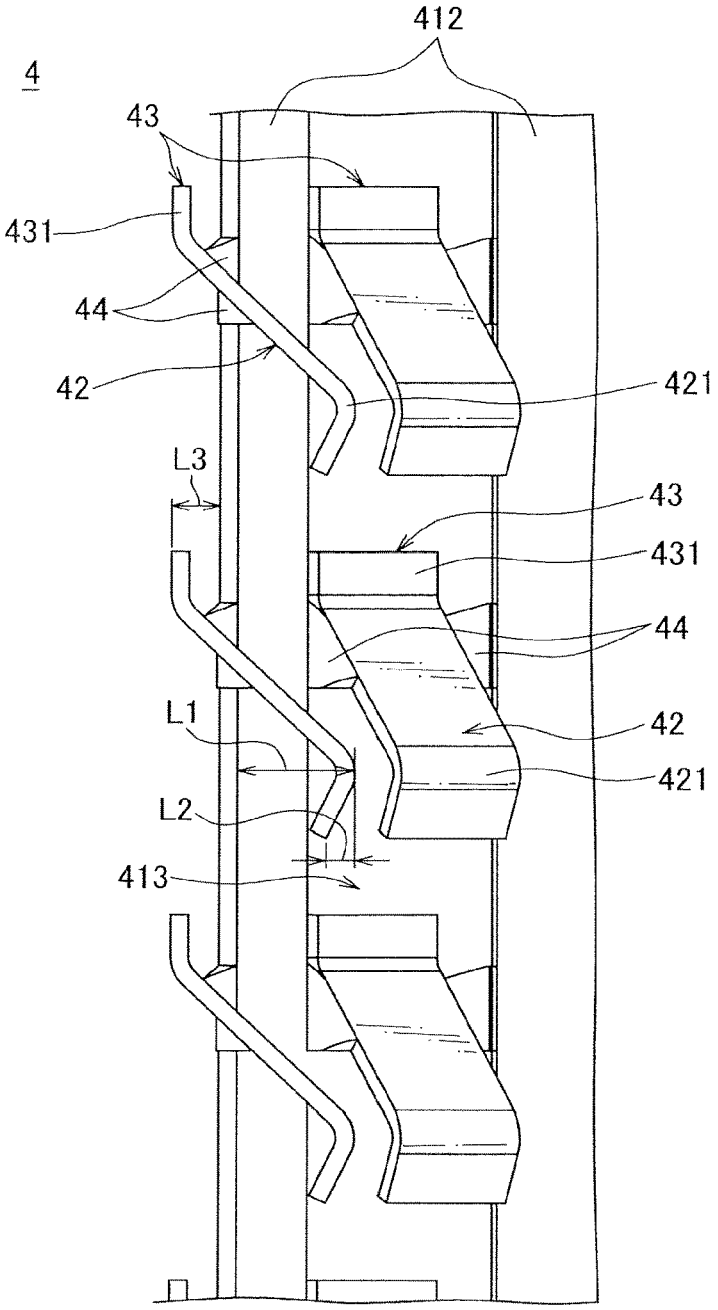
FIG. 6 is a cross-sectional view taken along arrow B-B of the contact illustrated in FIG. 5.

As illustrated in FIG. 5, the contact 4 is a columnar member made of a conductive spring material such as beryllium copper. The contact 4 includes a cylindrical portion 41 forming an external shape of the contact 4, a plurality of first connecting portions 42 each having a first abutting portion 421 abutting on an outer circumferential surface of the core post 2, a plurality of second connecting portions 43 each having the second abutting portion 431 abutting on an inner circumferential surface of the plug cap 3, and coupling portions 44 each coupling the first connecting portion 42, the second connecting portion 43, and the cylindrical portion 41 with each other.

The contact 4 can be manufactured by pressing a spring material to form the cylindrical portion 41, the first connecting portions 42, the second connecting portions 43, and the coupling portions 44. The contact 4 can also be manufactured by separately forming the cylindrical portion 41, the first connecting portions 42, and the second connecting portions 43, and coupling them by means of welding or the like.

The first connecting portions 42 and the second connecting portions 43 are spring members movably biasing the plug cap 3 in the right-left direction (the perpendicular direction to the fitting direction with the receiving connector 500) in a state in which electric connection to the core post 2 is maintained.

The cylindrical portion 41 includes two annular portions 411 located on the tip end side and the rear end side in the fitting direction and six strip portions 412 formed in strip shapes to connect the annular portions 411 and extending in the fitting direction. The strip portions 412 are provided at regular intervals in a circumferential direction of the annular portions 411, each part between the strip portions 412 in the circumferential direction penetrates in the radial direction, and this penetrating part 413 is provided with the first connecting portions 42 and the second connecting portions 43. Also, the diameter dimension of the cylindrical portion 41 is longer than that of the terminal portion 23 and is shorter than that of the inside surface of the terminal portion housing portion 32.

In the contact 4, the first connecting portion 42 and the second connecting portion 43 are integrated, seven members each formed by integrating the first connecting portion 42 and the second connecting portion 43 are arranged in each of the six penetrating parts 413 at regular intervals in the up-down direction, and each of the members is coupled with both the adjacent strip portions 412 via the coupling portions 44.

As illustrated in FIGS. 5 and 6, the first connecting portion 42 is bent downward from the coupling portion 44 and further inward in the radial direction than the cylindrical portion 41 by a dimension L1 illustrated in FIG. 6 and is once again bent downward and further outward in the radial direction by a dimension L2 illustrated in FIG. 6. The dimension L1 is set to be approximately equal to or slightly longer than a difference between the diameter dimension of the cylindrical portion 41 and the diameter dimension of the terminal portion 23 and can arbitrarily be set depending on the contact pressure and the contact area with the terminal portion 23 and the like. The dimension L2 is set to be shorter than the dimension L1. The bent part once again bent downward and further outward in the radial direction is the first abutting portion 421 abutting on the outer circumferential surface of the terminal portion 23 when the terminal unit 1 is assembled.

As illustrated in FIGS. 5 and 6, the second connecting portion 43 is bent upward from the coupling portion 44 and further outward in the radial direction than the cylindrical portion 41 by a dimension L3 illustrated in FIG. 6 and is once again bent upward. The dimension L3 is set to be approximately equal to or slightly longer than a difference between the diameter dimension of the cylindrical portion 41 and the diameter dimension of the inner circumferential surface of the terminal portion housing portion 32 and can arbitrarily be set depending on the contact pressure and the contact area with the plug cap 3 and the like. The part once again bent upward is the second abutting portion 431 abutting on the inner circumferential surface of the terminal portion housing portion 32 of the plug cap 3 when the terminal unit 1 is assembled.

The first connecting portion 42 and the second connecting portion 43 are made of a spring material, and are bent downward from the coupling portion 44 and further inward in the radial direction and bent upward from the coupling portion 44 and further outward in the radial direction, respectively, to function as spring members biasing the terminal unit 1 in the right-left direction (the perpendicular direction to the fitting direction with the receiving connector 500).

Also, in the present embodiment, the first connecting portion 42 is bent downward from the coupling portion 44 and further inward in the radial direction and is once again bent downward and further outward in the radial direction. Hence, when the contact 4 is inserted into the plug cap 3, the contact 4 can be inserted smoothly without the first connecting portions 42 getting stuck with the inner circumferential surface of the plug cap 3. Also, the second connecting portion 43 is bent upward from the coupling portion 44 and further outward in the radial direction and is once again bent upward. Hence, when the core post 2 is inserted into the contact 4, the core post 2 can be inserted smoothly without the second connecting portions 43 getting stuck with the outer circumferential surface of the core post 2.

The terminal cap 5 is a member attached to the tip end of the core post 2 to prevent the plug cap 3 from coming off, is made of a resin material, and has a truncated conical external shape in which the diameter dimension on the tip end side in the fitting direction is short. The terminal cap 5 is opened on the rear end side in the fitting direction to allow the terminal portion 23 to be inserted therein. The diameter dimension of the terminal cap 5 on the rear end side in the fitting direction is approximately equal to the outer diameter dimension of the terminal portion housing portion 32 of the plug cap 3. As illustrated in FIG. 3, the terminal cap 5 includes an engaging portion 51 protruded inward in the radial direction from the edge on the rear end side in the fitting direction and engaged with the engaging groove 233 of the terminal portion 23.

By engaging the engaging portion 51 with the engaging groove 233 of the core post 2, movement of the plug cap 3 in the up-down direction is regulated, and when the plug connector 100 and the receiving connector 500 are fitted or detached, the plug cap 3 can be prevented from coming off to the tip end side in the fitting direction, and movement of the plug cap 3 in the right-left direction is not inhibited. Meanwhile, although the diameter dimension of the terminal cap 5 on the rear end side in the fitting direction is approximately equal to the outer diameter dimension of the terminal portion housing portion 32 of the plug cap 3 in the present embodiment, the diameter dimension of the terminal cap 5 may be longer than the outer diameter dimension of the terminal portion housing portion 32.

Next, examples of methods for assembling the terminal unit 1 and the terminal assembly 101 will be described. The procedure of each assembling method is not limited to the following procedure, and the order may be changed as long as the configuration of each of the terminal unit 1 and the terminal assembly 101 is equal.

As illustrated in FIGS. 3 and 4, in assembling the terminal unit 1, the contact 4 is first inserted into the plug cap 3, and the core post 2 is inserted into the contact 4. In the state in which the core post 2 is inserted into the contact 4, the tip end portion 232 of the core post 2 is protruded from a portion on the tip end side of the plug cap 3 in the fitting direction. The engaging portion 51 of the terminal cap 5 is engaged with the engaging groove 233 of the protruded tip end portion 232 to complete assembling of the terminal unit 1.

The terminal assembly 101 is assembled by securing the four terminal units 1 to the conductive member 6. Specifically, the securing portions 215 provided at the top portions 21 of the core posts 2 of the four terminal units 1 are respectively inserted into the through holes 61 of the conductive member 6 from the lower side and are screw-shut by nuts or the like from the upper side of the through holes 61 to secure the four terminal units 1 to the conductive member 6. In this manner, assembling of the terminal assembly 101 is completed.

Next, the receiving connector 500 will be described. As illustrated in FIG. 1, the receiving connector 500 includes the tubular receiving housing 510 opened at the upper portion, the engaging projection portion 520 provided to be protruded from both side surfaces in the width direction of the receiving housing 510, and the receiving terminal 530 housed in the receiving housing 510. The receiving housing 510 and the engaging projection portion 520 are made of a resin material.

The receiving housing 510 includes four receiving terminal housing portions 511 independently housing the four receiving terminals 530 and arranged in the right-left direction and four plug terminal housing portions 512 communicating with the rear end side in the fitting direction of the receiving terminal housing portions 511 and allowing the four terminal units 1 of the terminal assembly 101 of the plug connector 100 to pass therethrough. In a state in which the plug connector 100 and the receiving connector 500 are fitted, the receiving terminal housing portions 511 and the plug terminal housing portions 512 are housed in the terminal unit housing portion 102*b* of the plug connector 100.

Figure 7:
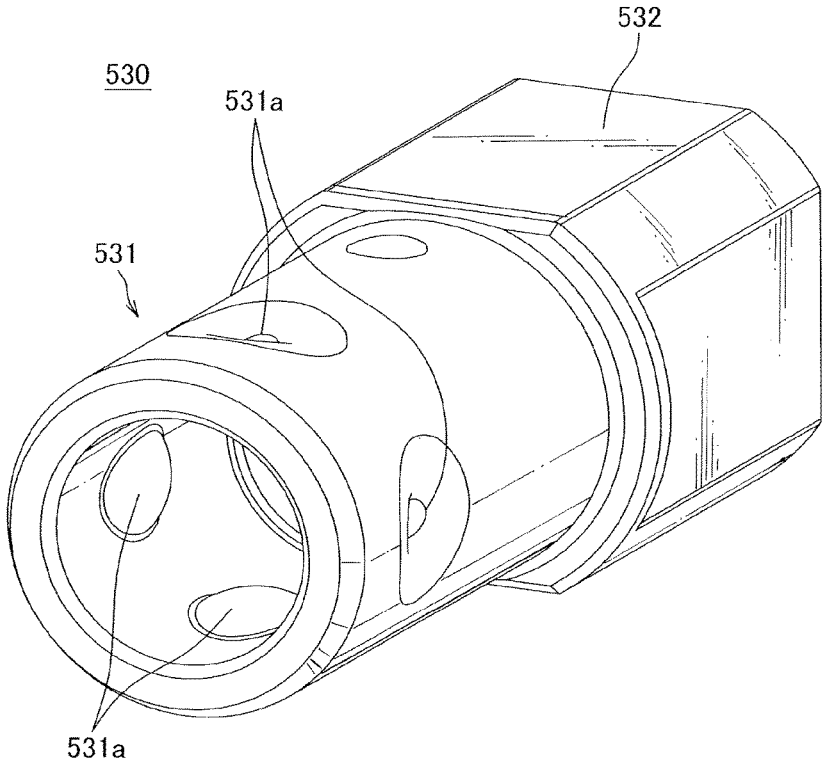
FIG. 7 is a perspective view illustrating a receiving terminal in the receiving connector illustrated in FIG. 3.

The receiving terminal 530 is made of a conductive material and includes a cylindrical portion 531 allowing the terminal unit 1 to be inserted therein and a base portion 532 as illustrated in FIG. 7. The cylindrical portion 531 includes spherical receiving abutting portions 531*a* abutting on the outer circumferential surface of the terminal portion housing portion 32 of the plug cap 3 in the fitting state with the plug connector 100 and protruded inward. Four receiving abutting portions 531*a* are provided at regular intervals in the circumferential direction of the cylindrical portion 531.

Next, movement in a case in which an angular error occurs when the plug connector 100 and the receiving connector 500 are fitted will be described.

When the plug connector 100 and the receiving connector 500 are to be fitted, there is a case in which the plug connector 100 is to be fitted diagonally against the receiving connector 500 or a case in which a dimensional tolerance at the time of manufacture of the plug connector 100 or the receiving connector 500 exists. In these cases, the axis of the terminal portion 23 of the plug connector 100 and the axis of the receiving terminal 530 of the receiving connector 500 may not be in the same direction, and an angular error may occur between the terminal portion 23 and the receiving terminal 530.

In a case in which the above angular error occurs, the terminal unit 1 abuts on one of the right and left sides of the plug terminal housing portion 512 of the receiving connector 500 earlier. At this time, the plug cap 3 moves in the right-left direction and in the diagonal direction with respect to the core post 2 to cause the axis of the terminal portion 23 and the axis of the receiving terminal 530 to be approximately in the same direction or be in the same direction, and the angular error is absorbed. At this time, the first connecting portions 42 and the second connecting portions 43 abut on the core post 2 and the plug cap 3 while being deformed to enable electric connection between the core post 2 and the plug cap 3 to be maintained.

Also, the contact 4 of the plug connector 100 is inserted between the core post 2 and the plug cap 3. Thus, when the terminal unit 1 of the plug connector 100 is inserted and pulled, the spring members of the contact 4 do not contact the member of the receiving connector. Accordingly, abrasion and deformation of the contact 4 can be restricted, and the angular error can be absorbed for a long period.

Also, in a case in which the contact pressure and the contact area between the members constituting the terminals are maintained as designed, the conductive part of the terminals is a highly-reliable contact point. Since abrasion and deformation of the contact 4 of the plug connector 100 are restricted, the contact pressure and the contact area between the contact 4 and the core post 2 or the plug cap 3 are maintained as designed for a long period, and the highly-reliable contact point can be obtained.

Also, since the angular error is absorbed in the terminal unit 1, the contact point between the terminal unit 1 of the plug connector 100 and the receiving terminal 530 of the receiving connector 500 does not need to be a contact point in which a spring member is used in the receiving connector 500. Accordingly, even in a case in which as a simply-formed contact point as the receiving abutting portion 531*a* is used, the highly-reliable contact point can be obtained.

According to the present embodiment, the first connecting portions 42 and the second connecting portions 43 of the contact 4 in the terminal unit 1 are spring members movably biasing the plug cap 3 in the perpendicular direction to the fitting direction with the receiving connector 500 in a state in which electric connection to the core post 2 is maintained. Hence, even in a case in which an angular error occurs between the terminal portion 23 of the plug connector 100 and the receiving terminal 530 of the receiving connector 500 when the plug connector 100 and the receiving connector 500 are to be fitted, the plug cap 3 moves in the right-left direction and in the diagonal direction, and the angular error can be absorbed. Also, when the plug cap 3 moves to absorb the angular error, the spring members keep abutting on the core post 2 and the plug cap 3, and electric connection can be maintained. Further, since the contact 4 is inserted between the core post 2 and the plug cap 3, the spring members of the contact 4 do not come in direct contact with the receiving terminal 530 of the receiving connector 500, abrasion and deformation resulting from prolonged use can be restricted, and the plug connector 100 withstanding prolonged use can be provided.

Also, since both the first connecting portion 42 and the second connecting portion 43 are spring members, the spring members abut on both the core post 2 and the plug cap 3 in comparison with a case in which either one is a spring member. Accordingly, electric connection between the core post 2 and the plug cap 3 can be established in a reliable manner.

Also, the terminal unit 1 includes the terminal cap, and the diameter dimension of the terminal cap 5 on the rear end side in the fitting direction is approximately equal to the outer diameter dimension of the terminal portion housing portion 32 of the plug cap 3. By engaging the terminal cap 5 with the core post 2, the plug cap 3 can be prevented from coming off to the tip end side in the fitting direction. Also, in a state in which the terminal unit 1 is assembled, while the plug cap 3 is prevented from coming off to the tip end side in the fitting direction, the plug cap 3 is not secured to the members such as the core post 2 and the terminal cap 5. Thus, the plug cap 3 receives resilience of the contact 4, can move in the right-left direction easily, and can absorb the angular error more easily.

It is to be noted that the present invention is not limited to the above embodiment, includes another configuration or the like enabling the object of the present invention to be achieved, and includes the following modifications.

In the foregoing embodiment, the first connecting portion 42 is bent downward from the coupling portion 44, and the second connecting portion 43 is bent upward from the coupling portion 44. However, in the present invention, the first connecting portion and the second connecting portion may be bent in either the upper or lower direction. For example, the first connecting portion and the second connecting portion may be bent upward and downward, respectively, both may be bent downward, or both may be bent upward.

Also, in the foregoing embodiment, both the first connecting portion 42 and the second connecting portion 43 are spring members. However, in the present invention, at least either the first connecting portion or the second connecting portion may be a spring member biasing the terminal unit in the perpendicular direction to the fitting direction with the counterpart connector. In a case in which either the first connecting portion or the second connecting portion is a spring member, the one that is not the spring member may be provided on the strip portion of the contact or on the same place as the strip portion. For example, in a case in which the first connecting portion is provided on the strip portion, the inner circumferential surface of the strip portion is a first abutting surface abutting on the outer circumferential surface of the core post, and the diameter dimension of the circumference provided with the strip portion is preferably set to be equal to the diameter dimension of the core post for reliable electric connection between the core post and the contact.

Also, in the foregoing embodiment, the terminal cap 5 is attached to the core post 2 by being engaged with the engaging groove 233 of the core post 2. However, the terminal cap may be attached to the core post in another way. For example, the terminal cap may be attached to the core post by screw-cutting the outer circumferential surface of the tip end portion of the core post and the inner circumferential surface of the terminal cap and screwing the core post and the terminal cap with each other. In this case, the terminal cap may be made of a resin material in a similar manner to the above embodiment or may be made of a conductive material.

Also, in the foregoing embodiment, the terminal unit 1 is provided in the plug connector 100. However, the terminal unit may be provided in the receiving connector. That is, a mechanism of absorbing the angular error may be provided in the receiving connector.

Although the best configuration, method, and the like for carrying out the present invention are disclosed in the above description, the present invention is not limited to these. That is, although the specific embodiment of the present invention is illustrated and described, the foregoing embodiment can be altered in various ways by those skilled in the art in terms of the shape, material, amount, and other detailed configurations without departing from the scope of the technical idea and object of the present invention.

Accordingly, since the above disclosed description in which the shape, material, and the like are specified is illustrative only to facilitate understanding of the present invention and does not limit the present invention, description of names of members in which limitation of the shape, material, and the like is partially or entirely removed shall be included in the present invention.

REFERENCE SIGNS LIST

100 plug connector (connector)
500 receiving connector (counterpart connector)
1 terminal unit
2 core post (terminal main body)
3 plug cap
4 contact
5 terminal cap
42 first connecting portion
43 second connecting portion
421 first abutting portion
431 second abutting portion

What is claimed is:

1. A connector comprising:

a plurality of terminal units, wherein the terminal unit includes:

a terminal main body;

a cylindrical plug cap having the terminal main body inserted therein and fitted with a counterpart connector; and a cylindrical contact that passes between the terminal main body and the plug cap, wherein the contact includes:

a first connecting portion having a first abutting portion abutting on an outer circumferential surface of the terminal main body; and a second connecting portion having a second abutting portion abutting on an inner circumferential surface of the plug cap, and wherein at least either the first connecting portion or the second connecting portion is a spring member that movably biases the plug cap in a perpendicular direction to a fitting direction with the counterpart connector in a state in which electric connection to the terminal main body is maintained.

2. The connector according to claim 1, wherein each of the first connecting portion and the second connecting portion is a spring member that biases the terminal unit in the perpendicular direction to the fitting direction with the counterpart connector.

3. The connector according to claim 1, wherein, in the terminal unit, a tip end of the terminal main body is protruded further on a tip end side in the fitting direction with the counterpart connector than the plug cap, and wherein the terminal unit further includes a terminal cap attached to the tip end of the terminal main body to prevent the plug cap from coming off.

4. The connector according to claim 2, wherein, in the terminal unit, a tip end of the terminal main body is protruded further on a tip end side in the fitting direction with the counterpart connector than the plug cap, and wherein the terminal unit further includes a terminal cap attached to the tip end of the terminal main body to prevent the plug cap from coming off.

* * * * *